US006261139B1

(12) United States Patent
Stiteler

(10) Patent No.: US 6,261,139 B1
(45) Date of Patent: Jul. 17, 2001

(54) STEERING CONTROL APPARATUS FOR INBOARD-OUTBOARD DRIVE

(75) Inventor: Andrew K. Stiteler, Bradenton, FL (US)

(73) Assignee: IMO Industries, Inc., Sarasota, FL (US)

( * ) Notice: Subject to any disclaimer, the term of this patent is extended or adjusted under 35 U.S.C. 154(b) by 0 days.

(21) Appl. No.: 09/641,041

(22) Filed: Aug. 17, 2000

Related U.S. Application Data

(60) Provisional application No. 60/149,548, filed on Aug. 18, 1999.

(51) Int. Cl.[7] ..... B63H 25/42
(52) U.S. Cl. ..... 440/61; 114/150
(58) Field of Search ..... 440/61, 900, 112, 440/53; 114/150

(56) References Cited

U.S. PATENT DOCUMENTS

| | | |
|---|---|---|
| Re. 30,122 | 10/1979 | Brownlie et al. . |
| 4,295,833 | 10/1981 | Borst . |
| 4,297,097 | 10/1981 | Kiekhaefer . |
| 4,432,737 | 2/1984 | Johansson . |
| 4,544,362 | 10/1985 | Arneson . |
| 4,557,695 | 12/1985 | Neisen . |
| 4,645,463 | 2/1987 | Arneson . |
| 4,919,630 | 4/1990 | Erdberg . |
| 5,201,238 | 4/1993 | Hayaska . |
| 5,205,764 | 4/1993 | Thiger . |
| 5,340,341 | 8/1994 | Yoshimura . |
| 5,542,864 | 8/1996 | Peebles . |

FOREIGN PATENT DOCUMENTS 4-362494-A * 12/1992 (JP) ..... 114/61

OTHER PUBLICATIONS

"OEM Business" Boating Industry, May, 1999.

* cited by examiner

*Primary Examiner*—Sherman Basinger
(74) *Attorney, Agent, or Firm*—Jansson, Shupe & Munger, Ltd.

(57) ABSTRACT

A steering control apparatus 10 for inboard-outboard marine drives having an hydraulic steering cylinder 20 mounted horizontally along the transom 16 at an inboard position centered above and across the drive train 17 and tiller 18, and a rigid linkage 22 between and engaging the distal portion 20D of the cylinder rod 20B and the operator end 18A of the tiller, such linkage extending from the cylinder rod downwardly and from there along and below the cylinder. In one preferred embodiment the cylinder is of the balanced type. In another, the horizontal linkage includes a first end 22A connected to the tiller and an upturned end 22B connected to a vertical drag link adapter 24, which is connected to the distal portion of the cylinder rod, thereby accommodating the possible presence of other apparatus. Yet another preferred embodiment includes a bracket assembly 30 including a transom adaptor member 30A2.

20 Claims, 4 Drawing Sheets

STEERING CONTROL APPARATUS FOR INBOARD-OUTBOARD DRIVE

RELATED APPLICATIONS

This application claims priority from the provisional patent application Ser. No. 60/149,548 filed Aug. 18, 1999.

FIELD OF THE INVENTION

This invention is related generally to steering control apparatus for inboard-outboard marine drive units and, more particularly, to steering control apparatus for sterndrive units for pontoon boats, houseboats, and other boats having a confined areas near the transom for steering control apparatus.

BACKGROUND OF THE INVENTION

Inboard-outboard marine drive units present particularly difficult marine steering problems. Inboard-outboard marine drives, of course, are those having an outboard propellor assembly (with all the related drive train gearing, etc.), an inboard engine adjacent to the boat transom, a drive train through the transom between the engine and propellor assembly, and some kind of apparatus for changing the directional orientation of the outboard propellor assembly for purposes of steering.

A variety of steering control apparatuses have been developed for such units, including steering apparatus using cables (with all the related necessary paraphernalia), certain hydraulic apparatus with cylinders and control linkages mounted in various positions to carry out the necessary steering functions, and various other power-steering arrangements. Considerable development efforts have been made toward solving inboard-outboard steering control problems, but difficult problems and disadvantages remain in the field of steering of boats using inboard-outboard drives.

Inboard-outboard steering apparatus problems are particularly difficult in pontoon and houseboat applications, and for other boats having confined areas near their transoms. It is believed that inadequate steering arrangements have limited the number of sterndrive pontoon boats and the like which have been introduced into the marketplace.

In boats having inboard-outboard drive units of various kinds, it is typically desirable to conserve space within the boat, and thus desirable to have the engine close to the transom and to minimize the size of the engine compartment. Among the problems associated with typical inboard-outboard steering devices has been the inherent limitations imposed on boat designers who seek to accommodate steering systems to engine compartments of limited size. As a result, there have been shortcomings in steering apparatus and a lack of adequate mounting systems for steering apparatus.

Due to the typically restricted size of engine compartments in such boats, in some cases designers have had to construct separate cable boxes near the engine compartments, which necessarily take up additional floor space. Furthermore, designers have been required to exercise particular care in routing cables to avoid sharp bends and the like in an effort to ensure that cables have adequate room for free movement, in order that the cable itself does not impede steering or cause steering lock-ups. Cable steering systems can also give rise to potential leakage problems because of various holes typically required for cable systems.

Hydraulic steering systems have been developed and used for pontoons and houseboats and other boats with inboard-outboard drives, and can eliminate some of the above-noted concerns and limitations associated with cable systems. Examples of prior hydraulic steering devices for inboard-outboard drives are disclosed in U.S. Pat. Nos. 4,295,833, 4,557,695, 4,645,463 and 5,340,341.

In the field of hydraulic steering apparatus for inboard-outboard marine drive, there are continuing problems, however, relating to difficulty in installation, use of excessive space, lack of ready understandability, and/or difficulty in serviceability. The marine industry continues to recognize the need for steering systems which are easily installed, take little space, are readily understood and easily serviceable.

OBJECTS OF THE INVENTION

It is an object of this invention to provide an improved inboard-outboard steering control apparatus overcoming some of the problems and shortcomings of the prior art.

Another object of this invention is to provide an improved inboard-outboard steering apparatus providing particular advantages for pontoons and houseboats, and allowing the use of hydraulic steering apparatus for such drive units.

Still another object of this invention is to provide an improved hydraulic steering system for inboard-outboard marine drives which is easily installed, takes little space, is easily understood, and is readily serviceable.

These and other objects of the invention will be apparent from the following descriptions and from the drawings.

SUMMARY OF THE INVENTION

The invention is an improved steering control apparatus for inboard-outboard marine drive units. Inboard-outboard marine drive units are marine drives of the type having an outboard propellor assembly, an inboard engine adjacent to the boat transom, and a drive train through the transom between the engine and the propellor assembly. Many of such inboard-outboard drive units include a tiller which is above the drive train and extends from the propellor assembly through the transom to terminate in an operator end inside the boat. This invention relates to a particularly advantageous arrangement of control cylinder apparatus for tiller position control in inboard-outboard marine drive units of this type.

More specifically, this invention includes a control cylinder (preferably an hydraulic cylinder) mounted in a substantially horizontal orientation along the transom at an inboard position substantially centered on and above the drive train and tiller, and a rigid linkage between and engaging the distal portion of the cylinder rod and the operator end of the tiller, such rigid linkage extending downwardly from the distal portion of the cylinder rod and from there substantially along and below the cylinder to where the operator end of the tiller is engaged.

The linkage preferably includes (1) a substantially horizontal link member which is connected at one end thereof to the tiller and extends to an upturned opposite end that is vertically aligned with the distal portion of the cylinder rod and (2) a substantially vertical drag link adapter which interconnects the distal portion of the cylinder rod and the upturned end of the horizontal link member. This arrangement has the added advantage of providing space between the hydraulic cylinder and the horizontal link member to accommodate the possible presence of other apparatus, such as parts related to or connected to the inboard engine assembly. In such embodiments, the connection between the horizontal link member and the tiller is pivotable, and the connection between the horizontal link member and the drag link adapter is pivotable.

In certain highly preferred embodiments, the hydraulic cylinder is of the balanced type. Such balanced hydraulic cylinders are seen in commonly-owned U.S. Pat. No. 5,542,864 (Peebles), the subject matter of which is incorporated herein by reference.

In preferred embodiments, the hydraulic cylinder is mounted to the transom, preferably using a bracket. The cylinder preferably includes a body member with a mounting portion centered along the length thereof, and a preferred bracket assembly includes first and second bracket portions for placement on the inboard and outboard sides of the transom, respectively, the first bracket portion being secured to the mounting portion of the hydraulic cylinder. In certain highly preferred embodiments, the first bracket portion includes a cylinder mounting member secured to the mounting portion of the hydraulic cylinder and a transom adaptor member secured to the inboard side of the transom and to the cylinder mounting bracket. The transom adaptor member preferably includes a transom-adjacent portion adjacent to the inboard side of the transom, a cylinder-adjacent portion adjacent to the cylinder mounting member, and a forwardly-extending portion extending between the transom-adjacent and cylinder-adjacent portions which serves to position the hydraulic cylinder substantially directly above the operator end of the tiller. The transom-adjacent portion and cylinder-adjacent portion preferably have off-parallel mounting surfaces so that the cylinder can be supported in an intended orientation despite angling of the transom.

The improved inboard-outboard drive steering control unit provides a number of significant advantages. One advantage of particular importance is that the inventive arrangement helps facilitate the use of hydraulic steering on pontoons and houseboats. Another is that installation problems for steering control systems, particularly for such boats, are significantly reduced. Furthermore, problems associated with cables and cable-control apparatus are essentially eliminated. The steering control arrangements of the present invention provide a simple, compact, readily-understood and easily-serviceable steering system for inboard-outboard drive marine units.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTION OF PREFERRED EMBODIMENTS

Figure 1:
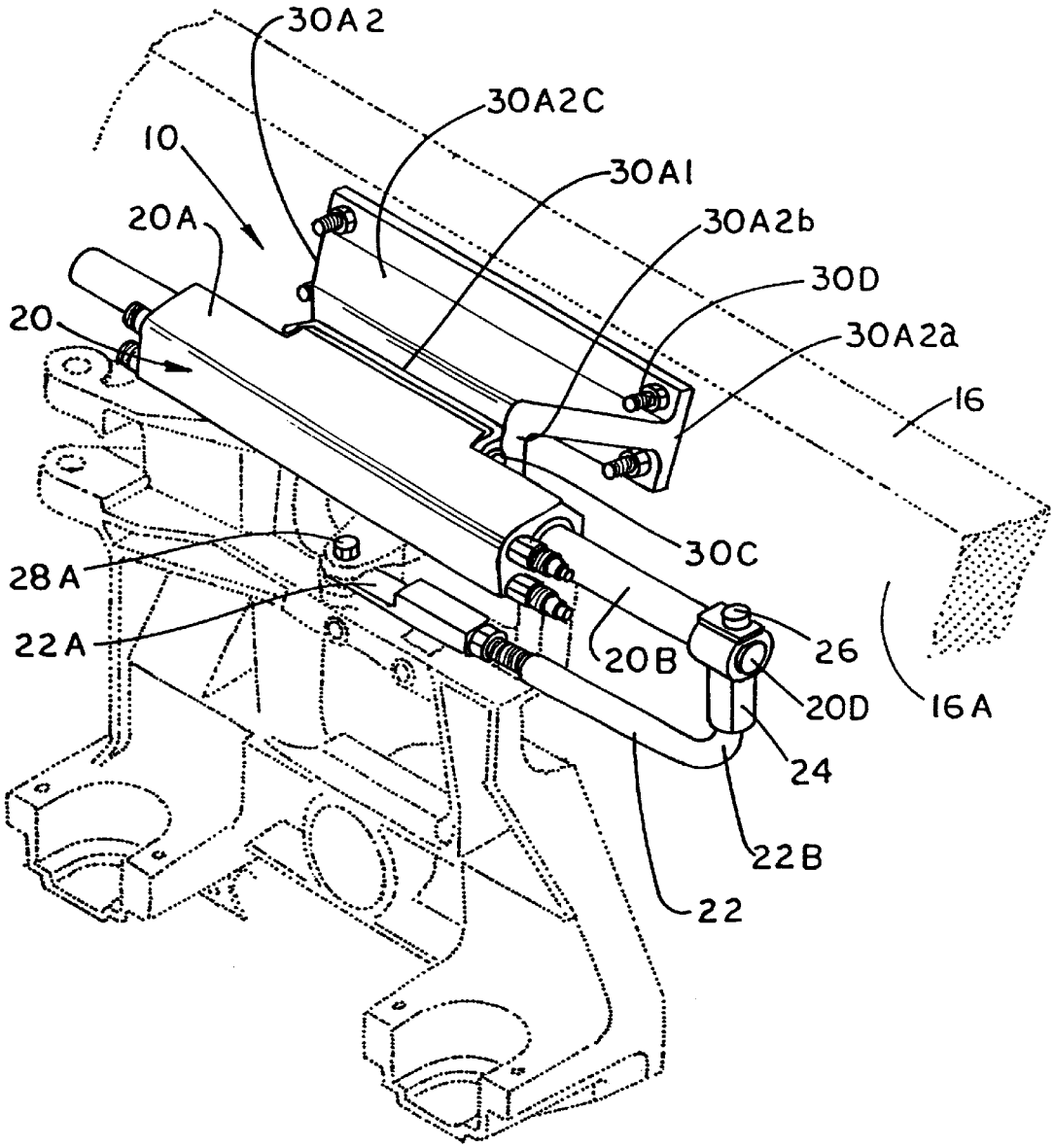
FIG. 1 is a perspective view of a preferred inboard-outboard drive steering control apparatus in accordance with this invention, mounted in place on the transom, with the inboard engine removed for clarity.
Figure 2:
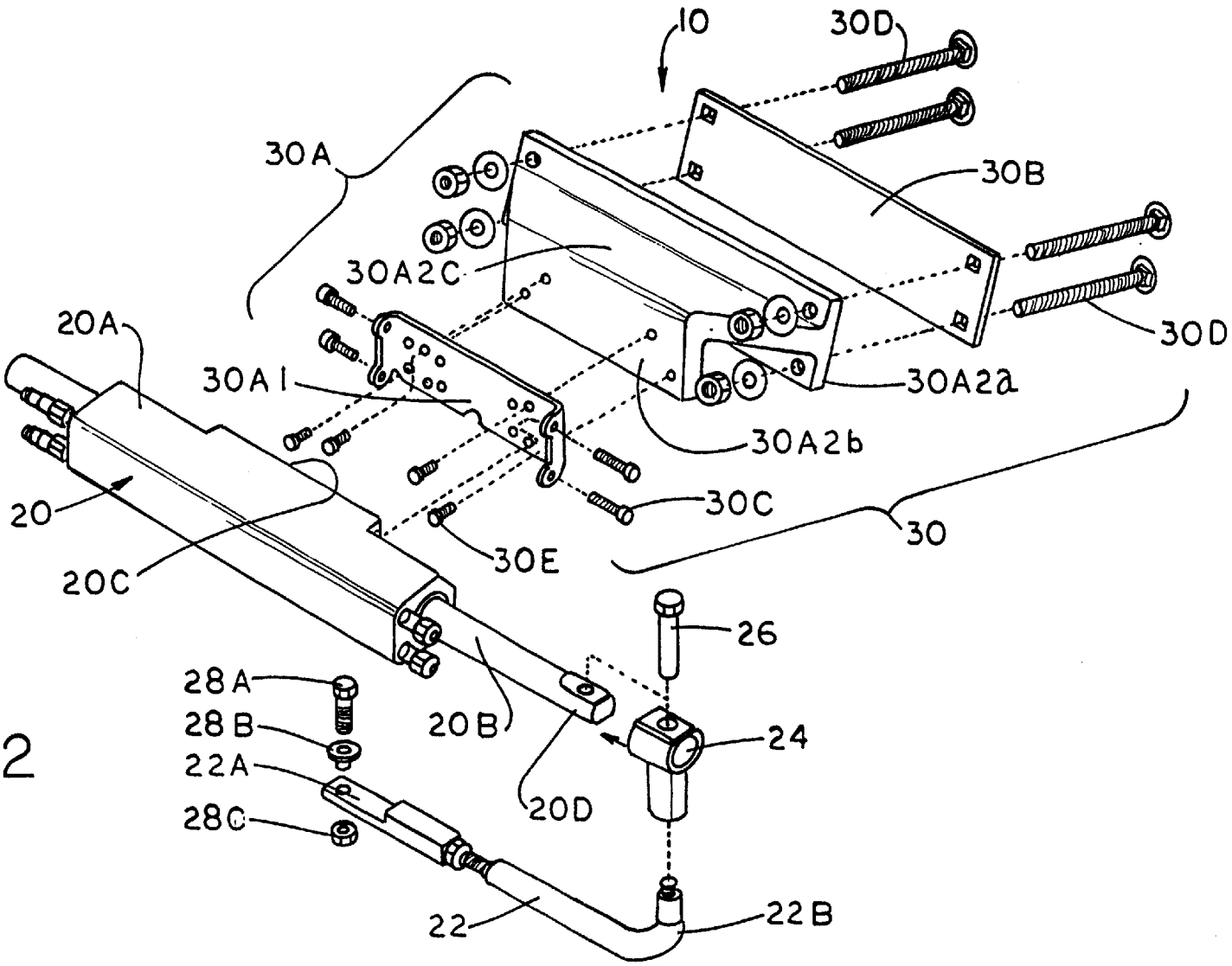
FIG. 2 is an exploded fragmentary perspective view of the steering control apparatus of claim 1.
Figure 3:
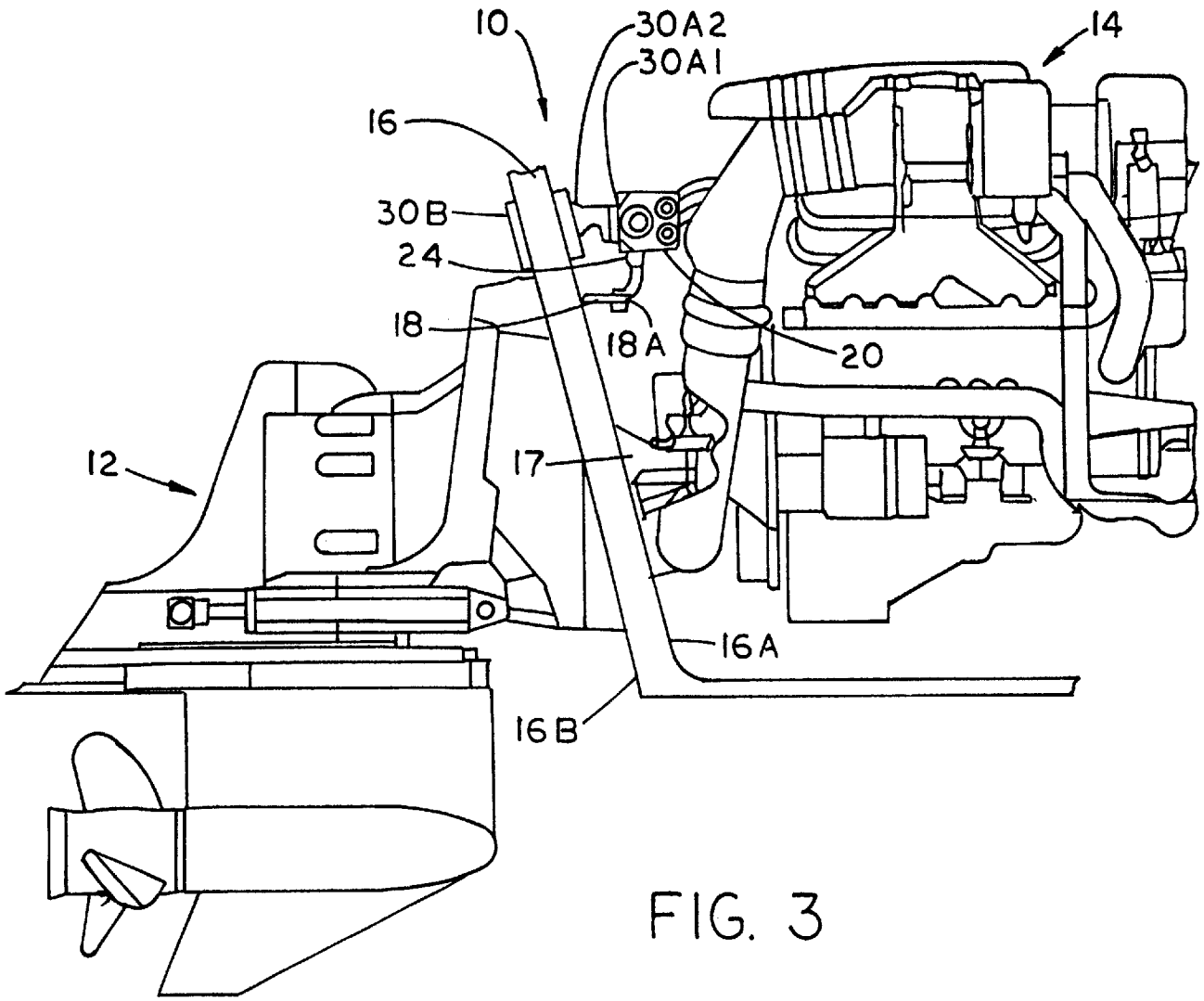
FIG. 3 is a partially-schematic side elevation of an inboard-outboard drive having the steering control apparatus of FIG. 1.
Figure 4:
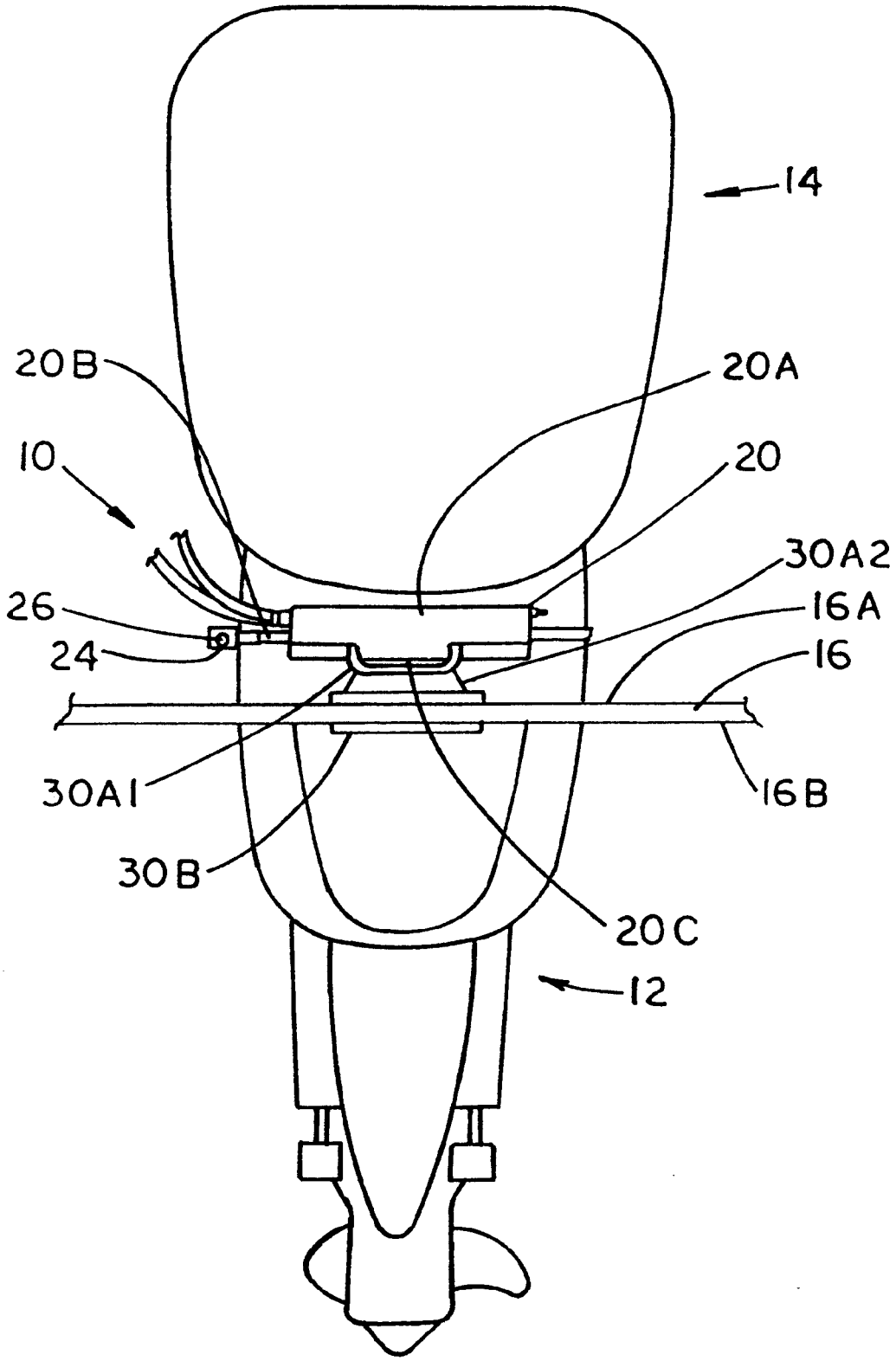
FIG. 4 is a partially-schematic top plan view of FIG. 3.

A preferred embodiment of the improved inboard-outboard hydraulic steering control apparatus is identified by numeral 10, shown in FIGS. 1–4. The figures, particularly FIGS. 3 and 4, show the location of steering control apparatus 10 in its mounted position with respect to an inboard-outboard marine drive unit, including an outboard propellor assembly 12 and an inboard engine 14 which are adjacent to and on opposite sides of a boat transom 16. A drive train 17 extends between inboard engine 14 and outboard propellor assembly 12, through transom 16. A tiller 18, which is above drive train 17, extends from propellor assembly 12 through transom 16 to terminate in a tiller operator end 18A.

An hydraulic control cylinder 20 is mounted in a horizontal orientation along transom 16 at an inboard position which is centered on and above drive train 17 and tiller 18. Hydraulic cylinder 20 is perpendicular to drive train 17 and is perpendicular to tiller 18, but spaced well above both tiller 18 and drive train 17, in a position which is readily accessible. Hydraulic cylinder 20 has hose connectors at either end and is of the balanced type referred to above.

Hydraulic control cylinder 20 includes a body member 20A and a cylinder rod 20B. Body member 20A includes a mounting portion 20C used for attachment of hydraulic cylinder 20 to transom 16, as hereafter explained. Cylinder rod 20B includes a distal portion 20D which is engaged with a rigid linkage extending to operator end 18A of tiller 18.

The rigid linkage includes a horizontal link member 22 which is connected at its first end 22A to operator end 18A of tiller 18. Horizontal link member 22 extends from first end 22A to an opposite upturned end 22B which is vertically aligned with distal portion 20D of cylinder rod 20B. A vertical drag link adapter 24 interconnects distal portion 20D of rod 20B with upturned end 22B of horizontal link member 22. An elongated drag link nut 26 extends through openings in drag link adapter 24 and rod 20B and is threadedly engaged with upturned end 22B. This provides a pivotable connection between horizontal link member 22 and drag link adapter 24. First end 22A of horizontal link member 22 includes a portion which is threadedly engaged for adaptation to dimensional requirements of the particular inboard-outboard on which steering control apparatus 10 is used, and includes a vertically oriented opening to facilitate engagement with tiller 18. First end 22A is pivotably secured to operator end 18A of tiller 18 by means of a bolt 28A and a bushing 28B, both of which extend through the opening in first end 22A, and a nut 28C engageable with bolt 28A.

This arrangement of hydraulic cylinder 20 in its upward fully-exposed central position adjacent to transom 16 provides significant advantages as indicated above. Furthermore, the arrangement of hydraulic cylinder 20 and the rigid linkage to tiller 18 provides a vertical space between hydraulic cylinder 20 and horizontal link member 22. This space is available to accommodate apparatus unrelated to steering, and allows use of the steering apparatus of this invention on a variety of inboard-outboard drives.

Hydraulic cylinder 20 is mounted to transom 16 by a bracket assembly 30. Bracket assembly 30 includes a first bracket portion 30A and a second bracket portion 30B for attachment on the inboard side 16A and the outboard side 16B of transom 16, respectively. First bracket portion 30A is secured to mounting portion 20C of hydraulic cylinder 20 by bolts 30C. First and second bracket portions 30A and 30B sandwich transom 16 to provide mounting of hydraulic cylinder 20 thereto by means of bolts 30D. More specifically, first bracket portion 30A includes a cylinder mounting member 30A1 secured to mounting portion 20C of hydraulic cylinder 20 and a transom adaptor member 30A2 secured to inboard side 16A of transom 16. Transom adaptor member 30A2 and cylinder mounting member 30A1 are joined to one another by screws 30E.

Transom adaptor member 30A2 includes a transom-adjacent portion 30A2*a* adjacent to inboard side 16A of transom 16, a cylinder-adjacent portion 30A2*b* adjacent to cylinder mounting member 30A1, and a forwardly-extending portion 30A2*c* extending between transom-adjacent portion 30A2*a* and cylinder-adjacent portion 30A2*b*. This arrangement serves to position hydraulic control cylinder 20 substantially directly above operator end 18A of tiller 18. Transom-adjacent and cylinder-adjacent portions 30A2*b* and 30A2*a* have off-parallel planar mounting surfaces so that cylinder 20 can be supported in an intended orientation despite angling of transom 16.

While the principles of this invention have been described in connection with specific embodiments, it should be understood clearly that these descriptions are made only by way of example and are not intended to limit the scope of the invention.

What is claimed is:

1. A steering control apparatus for inboard-outboard marine drive units with an outboard propellor assembly, an inboard engine adjacent to the boat transom, a drive train through the transom between the engine and the propellor assembly, and a tiller above the drive train and extending from the propellor assembly through the transom to terminate in an operator end, the improvement comprising:

an hydraulic cylinder mounted to the transom in a substantially horizontal orientation therealong at an inboard position substantially centered on and above the drive train and tiller, the hydraulic cylinder having a rod with a distal portion; and a rigid linkage between and engaging the distal portion of the cylinder rod and the operator end of the tiller, the rigid linkage extending from the distal portion downwardly and from there substantially along and below the cylinder.

2. The inboard-outboard steering control apparatus of claim 1 wherein the hydraulic cylinder is of the balanced type.

3. The inboard-outboard steering control apparatus of claim 1 wherein the linkage comprises:

a substantially horizontal link member connected at one end thereof to the tiller and extending to an upturned end vertically aligned with the distal portion of the cylinder rod; and a substantially vertical drag link adapter interconnecting the distal portion of the cylinder rod and the upturned end of the horizontal link member, whereby clearance is provided between the hydraulic cylinder and the horizontal link member to accommodate the possible presence of other apparatus.

4. The inboard-outboard steering control apparatus of claim 3 wherein the connection between the horizontal link member and the tiller is pivotable and the connection between the horizontal link member and the drag link adapter is pivotable.

5. The inboard-outboard steering control apparatus of claim 4 wherein the hydraulic cylinder is of the balanced type.

6. The inboard-outboard steering control apparatus of claim 1 further comprising:

the hydraulic cylinder including a body member with a mounting portion centered along the length thereof; and a bracket assembly with first and second bracket portions for attachment on the inboard and outboard sides of the transom, respectively, the first bracket portion being secured to the mounting portion of the hydraulic cylinder.

7. The inboard-outboard steering control apparatus of claim 6 wherein the first bracket portion includes:

a cylinder mounting member secured to the mounting portion of the hydraulic cylinder; and a transom adaptor member secured to the inboard side of the transom and to the cylinder mounting member.

8. The inboard-outboard steering control apparatus of claim 7 wherein the transom adaptor member includes:

a transom-adjacent portion adjacent to the inboard side of the transom;

a cylinder-adjacent portion adjacent to the cylinder mounting member; and a forwardly-extending portion extending between the transom-adjacent and cylinder-adjacent portions, whereby the transom adaptor member serves to position the hydraulic cylinder substantially directly above the operator end of the tiller.

9. The inboard-outboard steering control apparatus of claim 6 wherein the hydraulic cylinder is of the balanced type.

10. The inboard-outboard steering control apparatus of claim 6 wherein the linkage comprises:

a substantially horizontal link member connected at one end thereof to the tiller and extending to an upturned end vertically aligned with the distal portion of the cylinder rod; and a substantially vertical drag link adapter interconnecting the distal portion of the cylinder rod and the upturned end of the horizontal link member, whereby clearance is provided between the hydraulic cylinder and the horizontal link member to accommodate the possible presence of other apparatus.

11. The inboard-outboard steering control apparatus of claim 10 wherein the connection between the horizontal link member and the tiller is pivotable and the connection between the horizontal link member and the drag link adapter is pivotable.

12. The inboard-outboard steering control apparatus of claim 11 wherein the hydraulic cylinder is of the balanced type.

13. A steering control apparatus for inboard-outboard marine drive units with an outboard propellor assembly, an inboard engine forward of the boat transom, a drive train through the transom between the engine and the propellor assembly, and a tiller above the drive train and extending from the propellor assembly through the transom to terminate in an operator end, the improvement comprising:

a control cylinder mounted in a substantially horizontal orientation along the transom at an inboard position substantially centered on and above the drive train, the control cylinder having a rod with a distal portion; and a rigid linkage between and engaging the distal portion of the cylinder rod and the operator end of the tiller, the rigid linkage extending from the distal portion in a substantially vertical direction and from there substantially along and vertically spaced from the cylinder.

14. The inboard-outboard steering control apparatus of claim 13 wherein the control cylinder is mounted with respect to the transom.

15. The inboard-outboard steering control apparatus of claim 14 further comprising:

the control cylinder including a body member with a mounting portion centered along the length thereof; and a bracket assembly with first and second bracket portions for attachment on the inboard and outboard sides of the transom, respectively, the first bracket portion being secured to the mounting portion of the control cylinder.

16. The inboard-outboard steering control apparatus of claim 15 wherein the first bracket portion includes:

a cylinder mounting member secured to the mounting portion of the control cylinder; and a transom adaptor member secured to the inboard side of the transom and to the cylinder mounting member.

17. The inboard-outboard steering control apparatus of claim 16 wherein the transom adaptor member includes:

a transom-adjacent portion adjacent to the inboard side of the transom;

a cylinder-adjacent portion adjacent to the cylinder mounting member; and a forwardly-extending portion extending between the transom-adjacent and cylinder-adjacent portions, whereby the transom adaptor member serves to position the control cylinder substantially directly above the operator end of the tiller.

18. The inboard-outboard steering control apparatus of claim 13 wherein the control cylinder is of the balanced type.

19. The inboard-outboard steering control apparatus of claim 13 wherein the linkage comprises:

a substantially horizontal link member connected at one end thereof to the tiller and extending to an upturned end vertically aligned with the distal portion of the cylinder rod; and a substantially vertical drag link adapter interconnecting the distal portion of the cylinder rod and the upturned end of the horizontal link member, whereby clearance is provided between the control cylinder and the horizontal link member to accommodate the possible presence of other apparatus.

20. The inboard-outboard steering control apparatus of claim 19 wherein the connection between the horizontal link member and the tiller is pivotable and the connection between the horizontal link member and the drag link adapter is pivotable.

* * * * *